United States Patent [19]

Douglas

[11] 4,279,044

[45] Jul. 21, 1981

[54] FLUID SUPPORT SYSTEM FOR A MEDICAL PATIENT

[76] Inventor: Owen Douglas, 7905 - 90th Ave. SW., Tacoma, Wash. 98498

[21] Appl. No.: 94,980

[22] Filed: Nov. 16, 1979

[51] Int. Cl.[3] ..... A61G 7/04; A47C 27/10

[52] U.S. Cl. ..... 5/453; 5/455; 128/376

[58] Field of Search ..... 5/453, 454, 455, 456, 5/451, 449; 297/DIG. 3; 128/376, 377

[56] References Cited

U.S. PATENT DOCUMENTS

| | | | |
|---|---|---|---|
| 3,340,551 | 9/1967 | Hopkins | 5/453 |
| 3,354,476 | 11/1967 | Scales et al. | 5/453 |
| 3,822,425 | 7/1974 | Scales | 5/456 |

FOREIGN PATENT DOCUMENTS

| | | | |
|---|---|---|---|
| 1273342 | 5/1972 | United Kingdom | 5/455 |
| 1545806 | 5/1979 | United Kingdom | 5/455 |

*Primary Examiner*—Alexander Grosz

[57] ABSTRACT

Medical patients, such as those having burns or bed sores, are supported fully or in part by this fluid system, which is available in many embodiments. All embodiments are directed to reducing local bearing pressure on body tissue. Multiple flexible elements or cells of differing embodiments are filled with a pressurized fluid, usually air. These multiple flexible cells are generally supported on a fully adjustable hospital bed frame.

When all the cells are inflated by internal fluid pressure, upper portions of the cells contact one another to form an overall seal which substantially prevents the escape of any fluid under equal or lower pressure, which may be thereafter introduced into the spaces between the lower portions of the cells. By using selective fluid pressurization and supply systems, automatic valving action occurs whereby the patient's body weight is beneficially distributed and supported on fluid, substantially reducing the values of supporting pressures. Adjustment of the external fluid supply to the point where it slightly exceeds that in the interior of the cells causes the flexible cells below the patient to be deflated and to collapse. This results in the patient being supported upon a deep cushion of pressurized fluid, with the minimum possible values of pressure exerted upon the patient's skin. The flexible cells located beyond the periphery of the patient will remain inflated.

18 Claims, 44 Drawing Figures

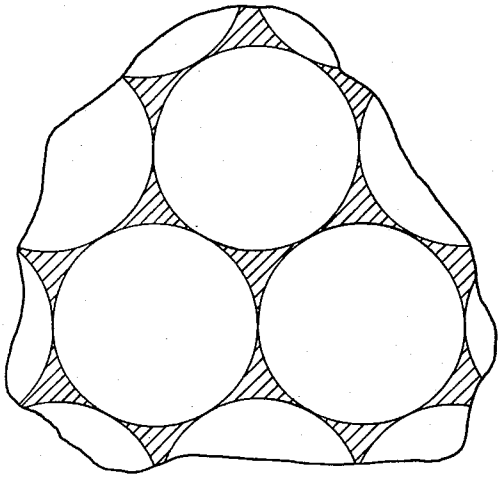
FIG. 1
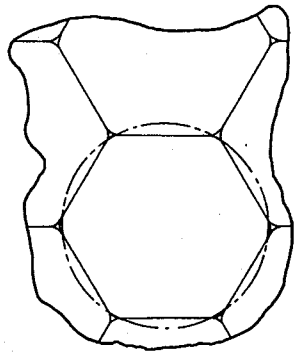
FIG. 2
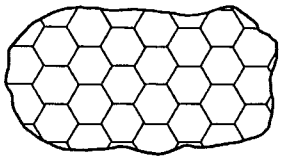
FIG. 3
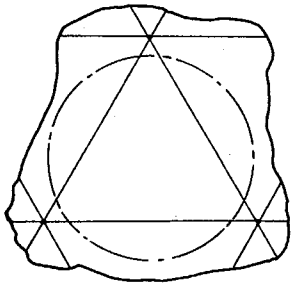
FIG. 4
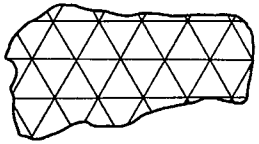
FIG. 5
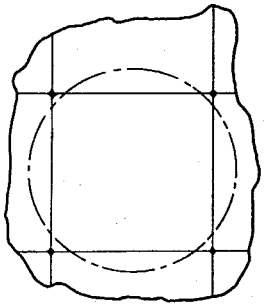
FIG. 6
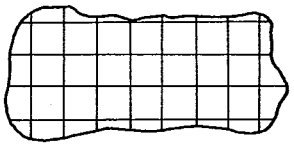
FIG. 7
FIG. 9
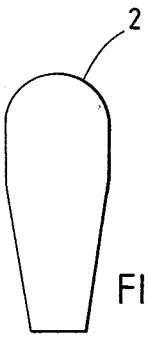
FIG. 10
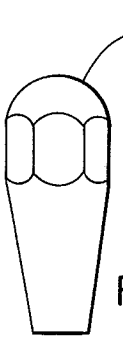
FIG. 11
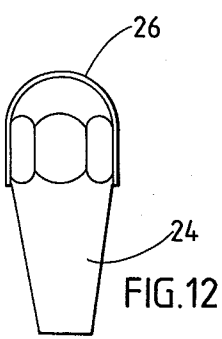
FIG. 12

FLUID SUPPORT SYSTEM FOR A MEDICAL PATIENT

BACKGROUND OF THE INVENTION

When a person is confined to bed, soft tissue is compressed between the skeleton and the supporting surface. Care is usually taken to provide a deformable mattress but, nevertheless, high local pressures occurring in the deformed tissue will compress blood vessels and tissue damage may result. A patient resting on a normal hospital bed will experience local pressures of the order of 150 mm Hg (2.9 psi). The blood pressure through the capillary vessels of the skin and underlying tissue is generally accepted as being 26 mm Hg (0.503 psi), but this figure may be considerably reduced for an ill patient. When contact pressures exceed this value, blood flow is stopped, resulting in transient damage and, finally, deep penetrating necrosis of tissue, muscle and bone. Skin may also be damaged by shear stresses resulting from friction between the skin and the supporting structure. Such stresses are a function of the local pressure and the area of contact.

Some improvements may be gained by the combination of the airfilled mattress with an air permeable top surface, as illustrated and described by Howarth in U.S. Pat. No. 3,778,851.

Subsequent to the inception of work upon air cushion vehicles, it became apparent that the air cushion principle could be used to provide the required evenly distributed, low pressure support desired for bedridden patients, especially those suffering from burns. In pursuit of this objective, a number of patents have been filed. For example, L. A. Hopkins and A. R. Tripp in U.S. Pat. No. 3,340,550 and L. A. Hopkins in U.S. Pat. No. 3,340,551 illustrate and describe apparatus for supporting a patient's body on a gaseous cushion. Examples of such apparatus have been built and are in operation for the treatment of burns in the United Kingdom. While they are effective, they do leave substantial areas for improvement, including (1) they are very expensive; (2) they have high power consumption; (3) the method of providing the seal for the air cushion supporting the patient requires individual adjustment of a large number of elements to suit the particular shape of the patient; and (4) their size, shape, weight and required ancillary equipment does not permit their being placed into conventional hospital rooms.

Subsequent to the development of the above apparatus, effort was directed toward the reduction of the power requirements and a so-called "Low Air Loss Bed" was developed. It is described in a United Kingdom Patent No. 1,273,342, and a similar apparatus is described by Dr. Scales in U.S. Pat. No. 3,822,425. This low air loss system does not support the whole area of the patient's body without contact, as does the higher air loss system, but it does reduce the higher body contact pressure by interposing an air film between the mattress and the patient's body at those points of higher body contact pressures. These earlier inventions are representative of the prior ways to support the human body by a gaseous cushion.

The embodiments hereinafter illustrated and described are distinguishable in the many ways they support the human body, in whole or in part. These systems are designed to be used with current hospital bed frames and/or other bed frames to provide the advantages of essentially contact-free, uniformly low pressure patient support at lower costs, greater ease of maintenance and sterilization and wider versatility in use. In systems for whole body support, they have the feature of automatically conforming to the variable contours, shapes and cross-sections of patients of differing sizes and weights and providing contact-free fluid support. In other smaller embodiments, these features are also realized when smaller selected portions of a body are supported.

SUMMARY OF THE INVENTION

Multiple flexible cells filled with a pressurized fluid, usually air, are arranged in different configurations, generally referred to as fluid support systems. The systems can be supported on a fully adjustable hospital bed frame, or any other bed frame, with or without adjustment to position a person in other than a supine position or, alternatively, an integral support may be included. Other smaller arrangements can be provided to support only selected, discrete body portions.

Each group of flexible, fluid-filled cells, is preferably surrounded by a fluid-retaining or boundary wall which may be rigid, flexible or inflatable. Each flexible cell is secured at its lower, generally smaller, end to a cell positioning board, which may be rigid or flexible, at respective orifices. These orifices are provided in the cell positioning board to direct pressurized fluid into the interior of each cell. In some embodiments, other orifices in the cell positioning board allow pressurized fluid to permeate the space around and between the cells. The cell positioning board constitutes the top surface of a plenum space containing pressurized fluid. The inflated shape of each cell consists of a top hemispherical portion, a generally cylindrical central portion, and a generally tapered lower portion which is open at the bottom and is attached to the cell positioning board around an orifice. The spacing of the flexible cells relative to their inflated diameter is such that they are forced into interfaces with each other in a polygonal format when viewed from above. When all the flexible cells are inflated by internal pressure, the interfaces form an overall seal which substantially prevents the escape of any fluid which may be later introduced into the spaces between the lower, tapered portions of the flexible cells. The flexible cells at the edges of the flexible cell group abutt a formed boundary member forming a seal around the periphery of the flexible cell group. Together, wth the top surface of the cell positioning board, these seals form a chamber consisting of all the available space between the flexible cells below the plane of collective interface of the flexible cells and within the boundary wall. By using selective fluid pressurization and supply systems, embodiments of these flexible cells may be operated with various internal pressures and the external pressure outside the lower portions of the cell may also be varied. The degree of sealing of the interfacing flexible cells is a function of the relative internal and external pressures of the flexible cells, as well as the spacing and material of construction of the flexible cells. Consequently, the regulation of the pressurized fluid controls the flexible cell action with respect to performing overall valving and sealing functions.

The fluid support system may be utilized, for example, in the treatment of a badly burned patient. The patient is placed gently over the grouping of flexible cells. Each cell is suitably spaced relative to the adjacent cells such that, when inflated by the internal fluid supply, the collective maximum cross-sections create a seal for the top of an exterior/external fluid plenum, or chamber. Suitable regulation of the relative pressures in the flexible cells and the exterior plenum controls the tightness of the upper overall cell interface seal for a given spacing and material of fabrication of the flexible cells.

When the patient is initially placed upon the fluid support system, only sufficient internal pressure is applied to the flexible cells to support the patient's weight in a passive or mattress-like manner. However, as soon as possible, the exterior/external fluid is applied at a pressure just sufficient to allow the escape of a small flow of fluid at the vertices of the interfaces of the polygonal cell sealing lines. This escaping fluid, which is dependent upon the relative internal and external pressure experienced by the cells, will flow into the spaces above the flexible cell interfaces. In the case of the flexible cells below the patient's body, the escaping flow will pressurize those spaces formed between the patient's body and the deformed flexible cells, thereby creating a thin pressurized fluid cushion under the patient's body. This will beneficially distribute the load on the patient's body, thereby reducing the values of peak pressures being experienced by the patient's body. Further adjustment of the external air supply to the point where it equals or exceeds that in the interior of the flexible cells will cause the flexible cells below the patient to be deflated and to collapse to a level near the top of the flexible cell positioning board. This will result in the patient's being supported upon a deep cushion of pressurized fluid, with the minimum possible values of pressure exerted upon the patient's skin. The collapsing action of the flexible cells below the patient's body results in substantially contact-free support being experienced by the patient. During this time, the flexible cells located beyond the periphery of the patient will remain inflated, as no pressure retaining barrier such as the patient's body exists above them. The overall seal made by the interface of the flexible cells located beyond the periphery of the patient is then maximized by further regulation of the relative internal and external pressure of the flexible cells, thereby decreasing the operating power requirements.

As arranged and operated, the fluid support system does not require structural adjustments for various sizes, weights and shapes of patients, as the combination of multiple flexible cells and the regulated internal and external fluid supplies result in a pressure sensing system which ensures that the flexible cells collapse only where required, thereby forming the appropriate shape and depth of fluid cushion below the patient required, with a minimum expenditure of operating power. The fluid used will generally be air but in some embodiments, it will be supplemented by water or other suitable fluids. In some embodiments, temperature and humidity control (heating and conditioning) of the fluid is undertaken as is filtration.

DESCRIPTION OF THE DRAWINGS

To illustrate the scope of the invention, there are many figures. The figures commence with illustrations of flexible cells, per se, and groupings of multiple flexible cells. Thereafter use of the groupings of multiple flexible cells is indicated and various embodiments show how the internal and external fluid supplies are derived and controlled. An arrangement of a system having compartmentalized pressure variation is illustrated. A typical embodiment of the invention with respect to providing partial body support is shown, as are various means of providing peripheral boundaries and restraints. The concluding views indicate a central fluid supply facility and other equipment in which the fluid support system may be installed. The drawings, in general, are semi-diagrammatic in that the number of flexible cell elements illustrated is less than might be used in practice.

FIG. 1 is a partial plan view of a grouping of thin flexible elements of circular cross-section which have been so arranged as to be mutually tangential.

FIG. 2 is a partial plan view, cross-section of a grouping of thin flexible elements of circular cross-section, as shown in FIG. 1, in which the horizontal and vertical spacing of the elements is so arranged that when the flexible elements are internally inflated, the cross-section of a discrete element becomes a hexagon. Each of these hexagons is contiguous with its neighbors. neighbors.

FIG. 3 displays, on a smaller scale, a larger number of elements arranged in the manner shown in FIG. 2 and demonstrates the tessalation pattern obtained.

FIG. 4 is a partial plan view, cross-section of a grouping of thin flexible elements of circular cross-section, in which the horizontal and vertical spacing of the elements is so arranged that when the flexible elements are internally inflated, the cross-section of a discrete element becomes an equilateral triangle. Each of these is contiguous with its neighbors.

FIG. 5 displays a larger number of elements arranged in the manner described in FIG. 4 and demonstrates the tessalation pattern obtained.

FIG. 6 is a partial plan view, cross-section of a grouping of thin flexible elements of circular cross-section, in which the horizontal and vertical spacing of the elements is so arranged that when the flexible elements are internally inflated, the cross-section of a discrete element becomes a square. Each of these squares is contiguous with its neighbors.

FIG. 7 displays a larger number of elements arranged in the manner described in FIG. 6 and demonstrates the tessalation pattern obtained.

FIG. 9 is a vertical view of a thin walled flexible element of circular cross-section. This has a hemispherical top and a tapered lower section.

FIG. 10 is a vertical view of another configuration of a thin walled flexible element of circular cross-section. This has a hemispherical top, cylindrical mid-section and a tapered lower section.

FIG. 11 is a vertical view of a thin walled flexible element in which the cylindrical cross-section illustrated in FIG. 10 has been replaced by a molded hexagonal cross-section over the mid-portion of the element.

FIG. 12 is a vertical view of an element in which the thin walled construction of FIGS. 9, 10 and 11 has been replaced by a foam structure. The foam structure is in the configuration of a hemispherical top, hexagonal mid-section and tapered lower section. The top, hemispherical surface is covered by an impervious coating or material. The composition of the foam is of interconnecting cellular structure.

DESCRIPTION OF PREFERRED EMBODIMENTS

Cell Matrix

The basis of the invention is a grouping of inflatable, flexible elements hereinafter called cells, which when inflated with pressurized fluid (generally air), mutually contact to provide a substantial seal or barrier to resist fluid flow at right angles to the plane of contact. This grouping of cells in conjunction with pressurized fluid supplies, boundary members and plenum chambers are utilized to provide both passive and active low pressure, evenly distributed load support systems for irregular loads such as the human body.

Although an arrangement comprising mutually tangential cells of circular cross-section, as shown in FIG. 1, could be utilized, the escape area formed by the vertices between the cells is great in relation to the area of an individual cell and the degree of sealing is minimal. A much improved degree of sealing is achieved if the geometric centers of the cells are placed such that their mutual spacing is less than the diameter of a discretely inflated cell. The cells can be so arranged that, when inflated, they form geometric shapes or tessalations other than circles and may be made to substantially contact adjoining cells in a manner which greatly reduces the relative escape area. The most simple of the possible methods of achieving this tessalation are those which utilize one and only one type of regular polygon. There are three basic forms of these tessalations. These are the square, the equilateral triangle and the regular hexagon.

These arrangements are shown in FIGS. 2 and 3, the regular hexagon; FIGS. 4 and 5, the equilateral triangle; and FIGS. 6 and 7, the square. More complex tessalations may be achieved using combinations of these basic elements. However, in all ensuing descriptions and drawings, the use of the hexagonal arrangement has been assumed for purposes of consistency and clarity.

For any particular tessalation, the relative areas of the cell and escape areas (i.e., the area within the vertices) are a function of the material properties, cell spacing and the relative internal and external pressures of the cells. By exercise of proper spatial relationships, relative pressures and material properties, the cell grouping may be made to contain pressurized fluid in those spaces, below the contact line of the cells and external to the cells, with little or no escape flow.

Figure 8:
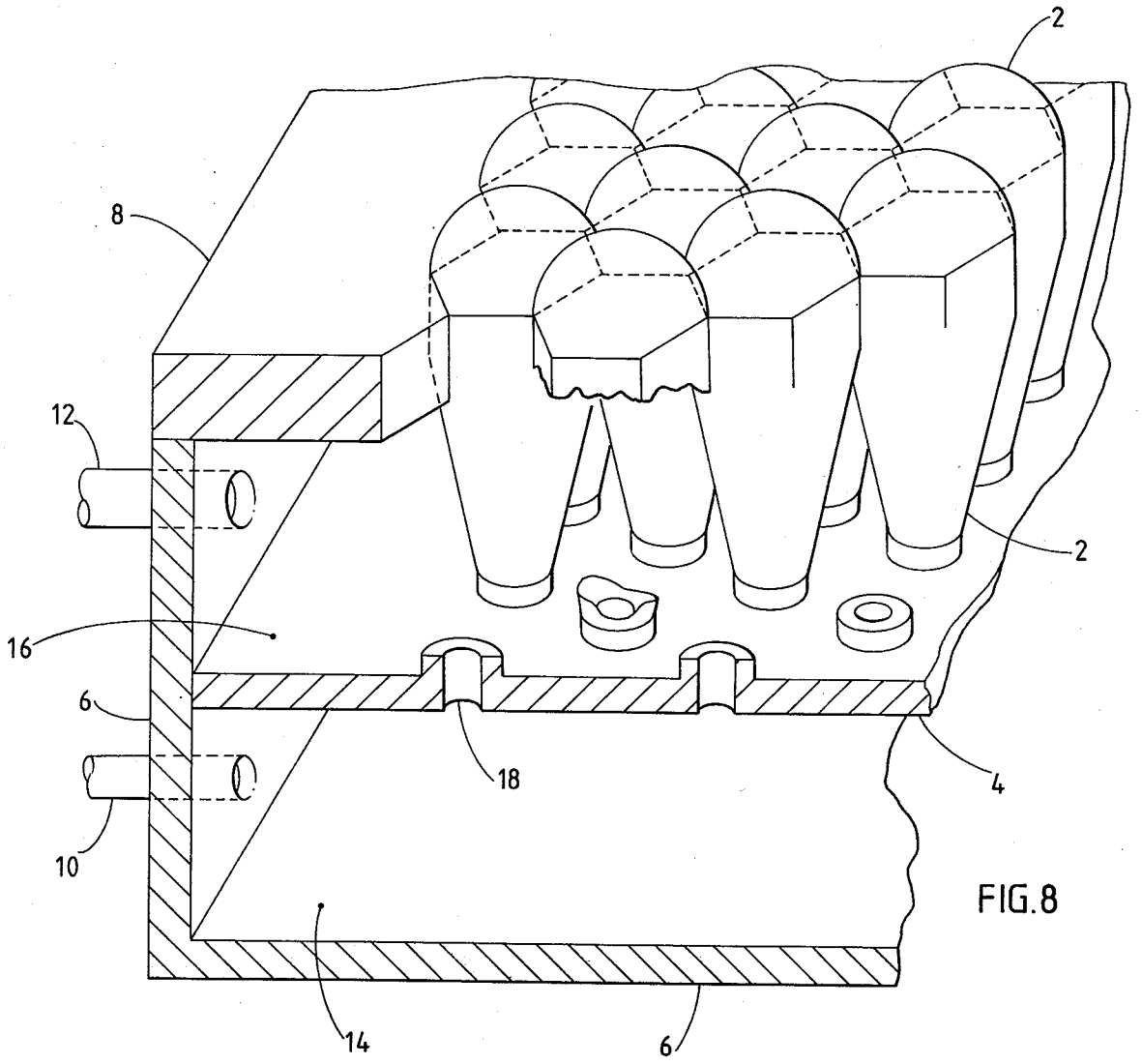
FIG. 8 is a partial, perspective, cross-sectional view of an embodiment of a fluid support system. This comprises a lower boxlike structure to the upper surface of which flexible, inflatable cell elements are attached. Provision is made for fluid to pass from this lower box, through holes, into the flexible cells, thereby inflating them. The outer, vertical structural members are continued above the level at which the flexible cells are attached, terminating in a horizontal, peripheral member which abutts and restrains the matrix of flexible cells. Ducts are provided for two discrete fluid supplies.
Figure 16:
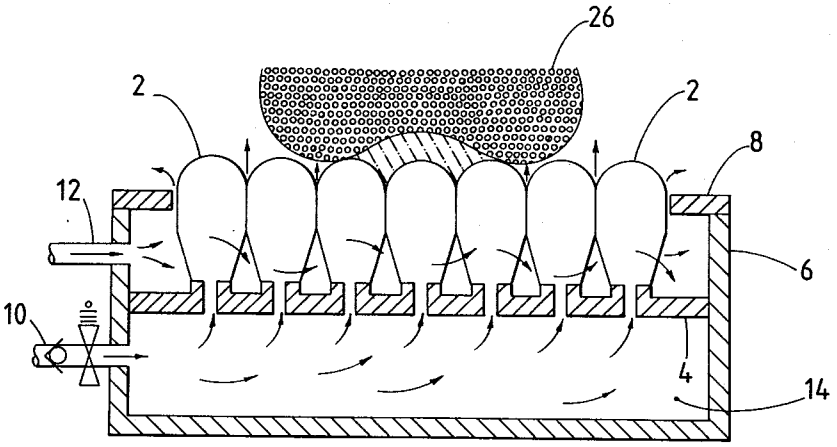
FIG. 16 is a vertical cross-sectional view as shown in FIG. 13 with the addition of a body being, transitionally, partially supported by fluid pressure.

FIG. 8 illustrates a typical arrangement of a grouping of tessalated cells, together with the boundary containment. The cells 2 are attached to a cell board 4, the lower surface of which, together with the lower portion of the outer structure 6, forms a plenum chamber hereinafter called the interior or internal plenum 14. Pressurized fluid is introduced into this internal plenum by means of a duct 10, thereby pressurizing and inflating the cells 2 by means of holes 18 located in the cell board 4, within the attachment of the cell to the cell board.

The sides of an external or exterior plenum 16 are formed by the upper portion of the vertical portion of the outer structure 6, together with a second horizontal boundary member 8. This latter member 8 is suitably shaped to accommodate the desired tessalation. These boundary members 6 and 8, together with the contacting plane surfaces of the cells 2 and the upper surfaces of the cell board 4 form an exterior or external plenum chamber 16 outside of the individual cells 2 up to the cell contact plane. This plenum may be pressurized by fluid introduced through a duct 12.

The fluid contained in this external plenum is allowed to escape through the vertices of contacting cells, the degree of escape being variable and controllable by the geometry of tessalation and relative internal and external pressures of the cells. In the general case, the pressurized supply to both the internal and external plenums is either from a common source or is regulated such that the fluid pressure at the entry points to the respective plenums is substantially equal. Under these circumstances, the fluid entering, inflating and pressurizing the individual cells 2 has no return circuit and consequently no pressure loss occurs in the internal plenum 14. A very small portion of fluid pressurizing the external plenum is allowed to escape through the vertices of the contacting cells. This results in a small pressure drop across the external plenum and, consequently, below the contact plane, the cell internal pressure is slightly higher than the external plenum pressure surrounding it. Consequently, the cells retain their individual inflated shapes. The hemispherical portion above the cell contact line remains inflated as the internal pressure is greater than the (atmospheric) ambient pressure above the cell.

Cell Configurations

The individual cells are fabricated from a flexible material. Due to the geometrical requirement that the pitch between two tessalated cells is less than the unrestrained diameter of a cell, a taper is generally required on the lower portion of the cell. Although a flat top cell would tend to inflate into a hemispherical top because flexible material is utilized, it is preferred that the cell be fabricated with a substantially hemispherical top to improve the sealing by reducing the tendency of the cell peripheral material to buckle. In certain of the passive systems described, the degree of taper is controlled and utilized to improve the conformance of the cells to irregular loads.

This is achieved because the resistance to vertical load of an individual cell, inflated only by internal pressure, is a function of the cross-section down to which the cell has been compressed and the internal pressure. For a given internal pressure, the deflection under vertical load of a cell having taper is a function of that taper. Consequently, for a tapered cell, a greater "stroke" can be achieved for any given cell leading to a better conformance and load distribution than for a cell having cylindrical form. The greatest degree of conformance is obtained with the maximum length and degree of taper below the hemispherical top (FIG. 9, Item 20).

However, consideration must be given to the improved sealing achieved when a parallel portion is located immediately below the hemispherical top (FIG. 10). This replaces the planar orifices of the cell vertices with full taper by tubes of some length and of singular cross-section having a greater resistance to flow and thereby increases the sealing or barrier capability.

As previously noted, the cells are fabricated from flexible material. They may be molded, knitted or otherwise fabricated. The embodiments later described have differing requirements in terms of porosity to fluids under pressure, but both pervious and impervious materials are utilized in the embodiments. The use of gas permeable material is also envisaged.

When the maximum sealing capacity of the cells is required, the cells may be molded or fabricated within the appropriate hexagonal, triangular or square cross-section 22 (FIG. 11), thus deleting the small corner radii present when initially round cross-sectioned cells are inflated into other regular geometric shapes.

An additional configuration shown in FIG. 12 is one in which the cell is fabricated from foam 24 of interconnecting or porous cell structure. A non-porous cap 26 is then incorporated to reduce flow and power requirements.

To facilitate assembly and replacement, all the embodiments of cells may be molded or fabricated in blocks, rather than as individual units.

Modes of Operation

The fluid support system hereinafter described has various forms of embodiment which can be categorized as operating in two modes; namely, active and passive. Some embodiments may be operated in either mode and these will be referred to as dual mode.

Active Mode

Figure 13:
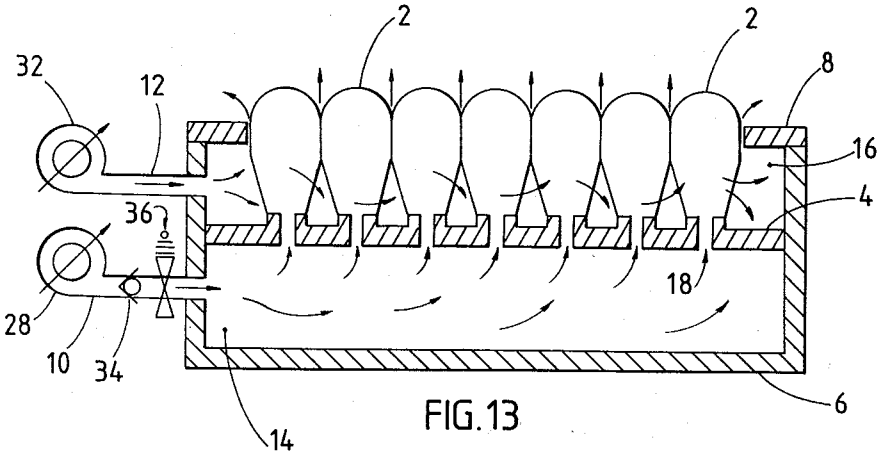
FIG. 13 is a vertical cross-sectional view of the dual mode fluid support system partially shown in FIG. 8. The means of providing and controlling discrete pressurized fluid supplies to the plenum chambers above and below the horizontal, rigid diaphragm are illustrated.

FIGS. 13, 14, 15, 16 and 17 illustrate the means by which an object such as a human body 26 may be supported upon a group or matrix of tessalated cells as previously described in FIGS. 1 through 8. FIG. 13 is a cross-section of a matrix of cells 2 within a boundary member 8. The cells are attached at their lower ends to a cell board 4. Provision is made, at each cell attachment point, for fluid to pass into the cell by means of an orifice 18 from the space below the cell board. The cell board 4 is attached in a fluid-tight manner within a box-like structure 6 in such a manner that its lower surface, together with the structure 6 forms a plenum space or chamber, hereinafter referred to as the interior plenum 14.

Figure 14:
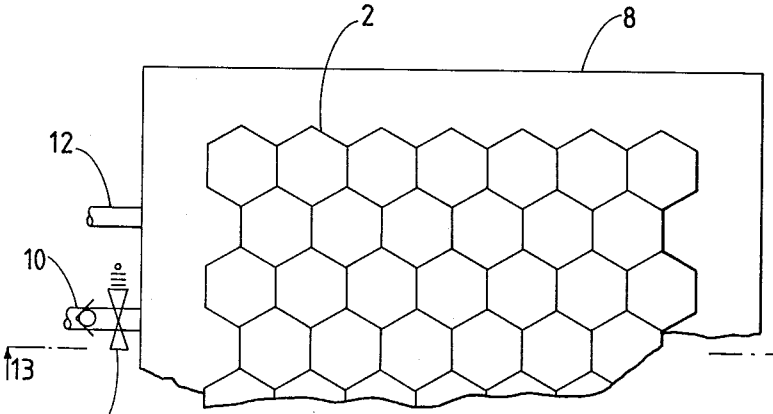
FIG. 14 is a partial plan view of the fluid support system illustrated in FIG. 13.
Figure 15:
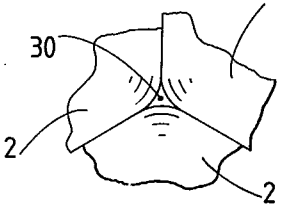
FIG. 15 is an enlarged plan view of the vertices of three of the contiguous elements illustrated in FIG. 14. The elements are inflated into a tessallated pattern and becomes largely contiguous, except for the small radii persisting at the vertices.

This interior plenum may be supplied with pressurized fluid by means of ducting 10 from a pressure source such as a variable speed pump or blower 28, thereby pressurizing and inflating each cell 2 by means of the orifices 18 in the cell board 4. Upon inflation, the cells 2 will, as previously described, form a geometric tessalation or matrix of the desired form as illustrated in FIG. 14. The mutual contact of the polygonal faces of the internally pressurized cells will form a barrier or seal to fluid seeking to pass through at right angles to the plane of the seal. The degree of sealing is partially dependent upon the pitch of the cell attachment points and may be arranged to be substantially complete, except for very small orifices 30 occurring at the vertices of the hexagons, as illustrated in FIG. 15.

The sides of the structure 6 extend above the level of the cell board 4 and terminate in a so-called boundary member 8 which abutts, and is suitably shaped to accommodate, the edge of the cell matrix pattern. This is illustrated in FIG. 14. These components 6, 8, together with the top of the cell board 4, the seal provided at the plane of contact of the cells at their collective maximum cross-sections as described above, and the exterior surfaces of the cells up to their mutual contact plane combine to form a second plenum space or chamber hereinafter referred to as the exterior plenum 16. This plenum may be supplied with pressurized fluid by means of a duct 12 and a pressure source such as a second variable speed pump or blower 32.

Subsequent to the inflation of the cell matrix and the establishment of its sealing characteristics, fluid introduced into the external plenum 16 is largely contained within that space. However, a small fluid flow to atmosphere will occur through the small orifices 30 at the vertices in the cell matrix. As noted above, the size of these orifices is partially dependent upon the cell spacing, but it is also a function of the relative internal and external pressures on the cell and, consequently, the flow to atmosphere may be minimized by adjustment of that relative pressure by means of regulating the pumps or blowers 28, 32.

Figure 17:
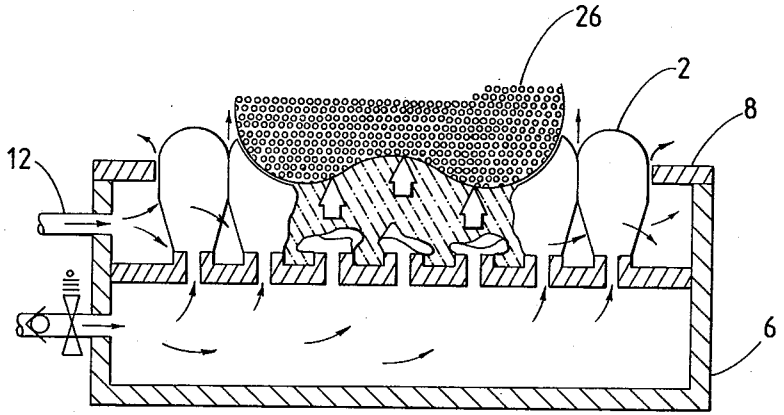
FIG. 17 is again a vertical cross-sectional view as shown in FIG. 13, but with the body now fully supported on a fluid cushion, the flexible elements under the body having been collapsed by the system's automatic sensing and valving actions.

In the general case, the pressurizing fluid in both plenums 14, 16 is assumed to be air at substantially equal pressures. The cells will remain inflated due to the presence of a lower (atmospheric) pressure above the cells. When a load such as a human body 26 is applied to the top of the cell matrix, the air escaping from the small orifices at the vertices of the cells will become entrapped between the body being lowered onto the cells and the top outer surface of the cells being covered by the body. This is illustrated in the process of occurring in FIG. 16, at the point where only a portion of the weight of the body 26 is being carried by the cells. At the point shown, the pressurized air escaping between the cells under the body will pressurize the enclosed space between the top of these cells and the body and, consequently, these cells now experience equal internal and external pressures and no force is available to maintain the inflated shape and position and they will collapse down toward the cell board 4. With progressive loading of the cells as the full weight of the body is borne by the support system, other cells under the body will similarly collapse, until such time as the body weight is borne and distributed upon a pressurized air cushion, with contact between the supported body and the cell material occurring only at the periphery of the body, as illustrated in FIG. 17.

The cells in contact with the edge of the body will deform as they are made from thin, flexible material and have only a low internal pressure. The cells beyond the periphery of the body will remain inflated as a differential exists between their internal pressure and the atmospheric pressure above them. When the conditions described above and illustrated in FIG. 17 are established, then suitable adjustment and regulation of the discrete fluid supplies is undertaken to minimize the size of the orifices at the vertices of the remaining portion of the cell matrix in order to conserve energy and minimize flow past the body being supported.

A significant feature of the system as describes is its ability to sense the shape of the load applied. The cell matrix generally will have a large number of individual elements, but only those elements which are covered by the body being supported are affected by the load. In essence, the system senses the shape of the load and performs valving action to replace the inflated cells by pressurized fluid to support the load. Consequently, no adjustment for the size, shape or cross-sectional contours is required for a wide range of patients from a small child to a large adult. Further embodiments are described later. However, all the active systems basically operate on the basis of a seal between a pressurized supply and atmosphere which, when the seal is loaded, sense the shape of the load and collapse away from it—leaving the load evenly supported on fluid.

The arrangement illustrated in FIGS. 13 through 17 can accommodate the use of differing fluids in the said plenums 14, 16. For instance, water may be used in the internal plenum 14 and air in the external plenum 16. Similarly, advantage may be derived from the use of air in the internal plenum 14 and an admixture of air and medically beneficial additives in the external plenum where they are brought into contact with the body.

The required regulation of the fluid supply pressure and flow to the discrete plenums will generally be achieved by means of independently controlling the speed of the pumps or blowers. However, other means of regulation are described and illustrated in later, more complex embodiments.

In FIG. 13, the pressurized supply to the internal plenum 14 is provided with a non-return valve 34 and an adjustable relief valve 36. These are not required for the basic operation in the active mode described above, but are related to improvement in the operation in the passive and dual modes presented in the following sections.

In the embodiment illustrated in FIGS. 13 through 17 and all others, provisions (not illustrated) may be incorporated for conditioning of the fluid or fluids used with respect to temperature and humidity control by the inclusion of commercially available components.

Passive Mode

Figure 18:
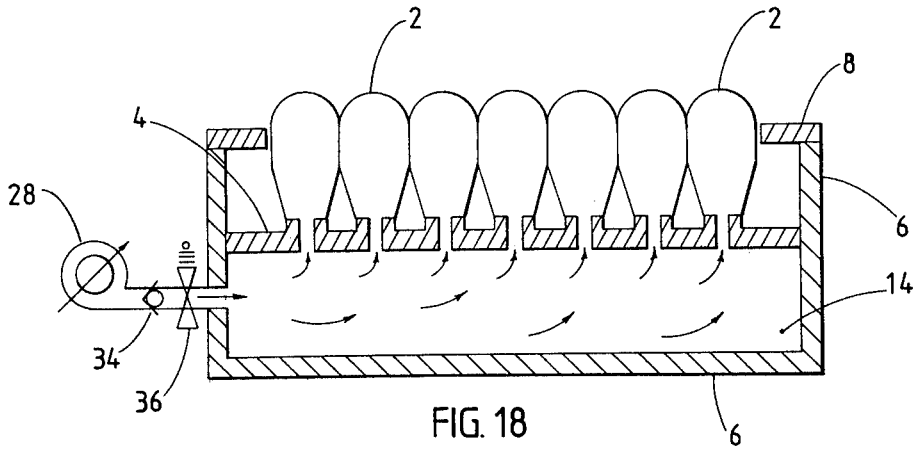
FIG. 18 is a vertical cross-section of a passive support system. It is comprised of a box-like structure with an internal, rigid diaphragm to the upper surface of which is attached a number of thin flexible elements which, when internally inflated, form a continuous upper surface of tessallated form. These elements are restrained in the planar sense by an upper horizontal member. Provision is made for pressurizing the flexible elements internally by means of a duct from a fan or pump. A relief valve is provided, as is a non-return valve on the fluid supply.

A simple passive support system is shown in cross-section in FIG. 18 where a grouping of cells as depicted in FIG. 3 is utilized. Pressurized fluid is supplied only to the interior of the cells. This causes them to inflate in a hexagonal matrix pattern. As this is a closed system, only sufficient flow is required to accommodate any leakage. The pressurized fluid may be provided by a pump or blower unit 28. Where the unit is in fact fluid-tight, a pump or blower unit is only required for initial inflation. A non-return valve on the supply 34 is provided as is an adjustable relief valve 36 to maintain constant pressure when the bed is laid upon. If no relief were provided, then the pressure would increase when a load was applied to the cell. The lowest possible support pressure for any given individual will, however, best be achieved by the use of a variable speed pump or blower unit.

Figure 19:
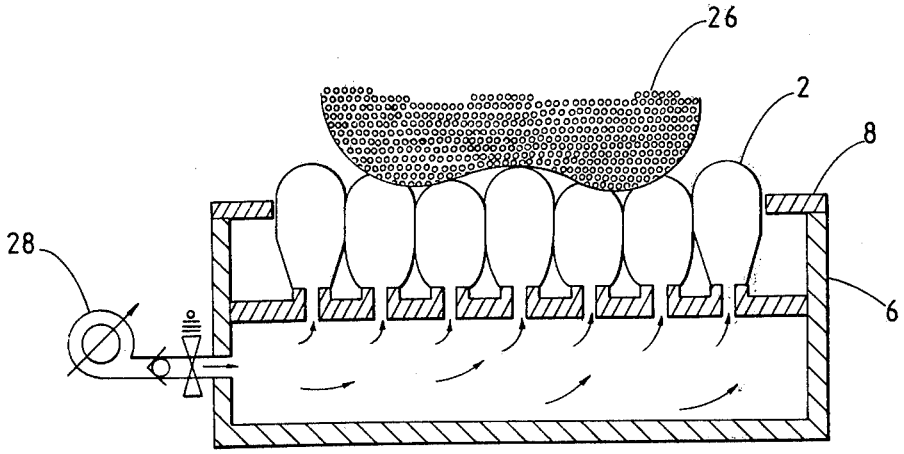
FIG. 19 is a cross-sectional view as in FIG. 18 with the addition of a representative body being passively supported.

Significant advantages are achieved by this arrangement, for both the case where the pressurizing fluid is liquid and that where the pressurizing fluid is gaseous. In both instances, the cells 2 (although stable in the planar sense) are free to shear vertically one against the other. This, in combination with the tapered lower section of the cell (which decreases vertical stiffness and increases the ability to stroke or conform to an irregular shape) ensures much greater capability to support a load with a uniform support pressure. The human body 26 shown on the support system in FIG. 19 is of complex shape and cross-sections and the system described not only distributes the load in an optimum manner for a passive system, but has the significant advantage that shearing forces on the skin are obviated or very much reduced.

Where the pressurizing fluid is a liquid such as water, two additional advantages are gained over the conventional waterbed system. Firstly, the weight of the mattress is much reduced. Secondly, the undesirable "swishing" characteristic is obviated by the absence of free surface in the small cells.

Dual Mode Operation

The fluid support system illustrated in FIG. 13 may, by reason of the separate plenum pressurizing arrangements, be operated either in the active or passive mode. This provides advantages over systems which may only be operated in one mode or the other. While the passive mode provides significant improvement over a conventional mattress, air bed or waterbed in its ability to distribute load and reduce shear forces on the skin, it is nevertheless inferior in these characteristics to the active mode which, in addition to the benefit of no material contact, provides superior load distribution by means of fluid support which is of particular significance in the cases where the bottom surface of the body to be supported has a high degree of concavity. However, the passive system characteristics can be utilized in combination with the active system in the following manner.

No requirement exists in the passive mode for the cells to be pressurized on the outside of their lower, tapered ends; consequently, no requirement for the cell grouping or matrix to perform the sealing function for the fluid pressure exists. Therefore, when operating in the passive mode, after suitably increasing the internal pressure, cells may be arranged to be removable in blocks or sections, leaving the body supported upon the remaining cells. Consequently, a dual mode system which has become soiled during operation may be switched to passive mode operation in order to remove and replace cells for cleaning and sterilization. In addition, the dual mode system provides redundant means of support in case of component failure.

Dual Mode Fluid Support Systems with Single Pressure Source

Figure 20:
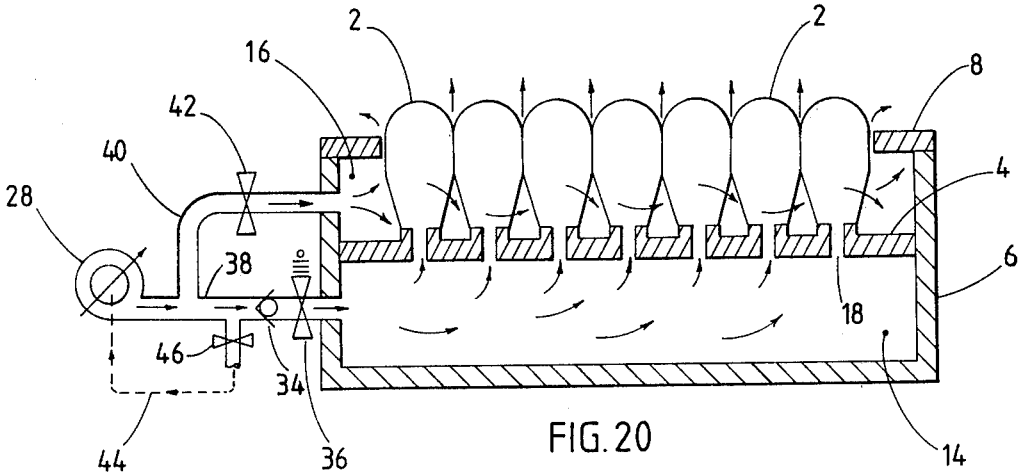
FIG. 20 illustrates a cross-section of an embodiment utilizing the majority of the components in FIG. 13, but is distinguished by the utilization of only one pump or blower to provide the fluid supplies to the two separate plenum chambers to provide dual mode operation.

The fluid support system illustrated in FIG. 20 utilizes the majority of the components and arrangements of the system illustrated in FIG. 13. However, only one blower is utilized. In combination with suitable ducting and valving, the system is capable of operation in either the passive or active mode.

The fluid supply from the variable speed pump or blower is divided into two branches, 38 and 40, which feed pressurized fluid to the internal plenum, 14, and the external plenum, 16, respectively. As the flow path to the internal plenum is essentially a closed circuit, the majority of the fluid will pass through the duct 40 to the external plenum 16. A valve or variable orifice 42 is provided to regulate this flow. The duct 38 originates at or near the pump or blower discharge in order to maximize the available fluid static pressure. As described in previous arrangements, this supply to the internal plenum 14 is provided with a non-return valve 34 and a variable relief valve 36. However, it is also provided with a bleed duct 44 and valve or variable orifice 46 in that duct. This provides means to regulate the internal plenum pressure independently of pump or blower speed. If, as illustrated, the bleed duct 44 is returned to the intake of the pump or blower 28, then the internal plenum pressure may be varied for any given pump or blower speed, from almost no pressure rise to the maximum available discharge static pressure, by controlling the degree of bleed-off, utilizing the valve or variable orifice 46.

Selective management of the speed of the pump or blower 28, valve 42 and bleed valve 46 provides control of both the absolute values of and the relationship between the fluid pressures in the internal and external plenums. Consequently, the system illustrated in FIG. 20 is capable of operating in either the passive or active mode of support.

Figure 21:
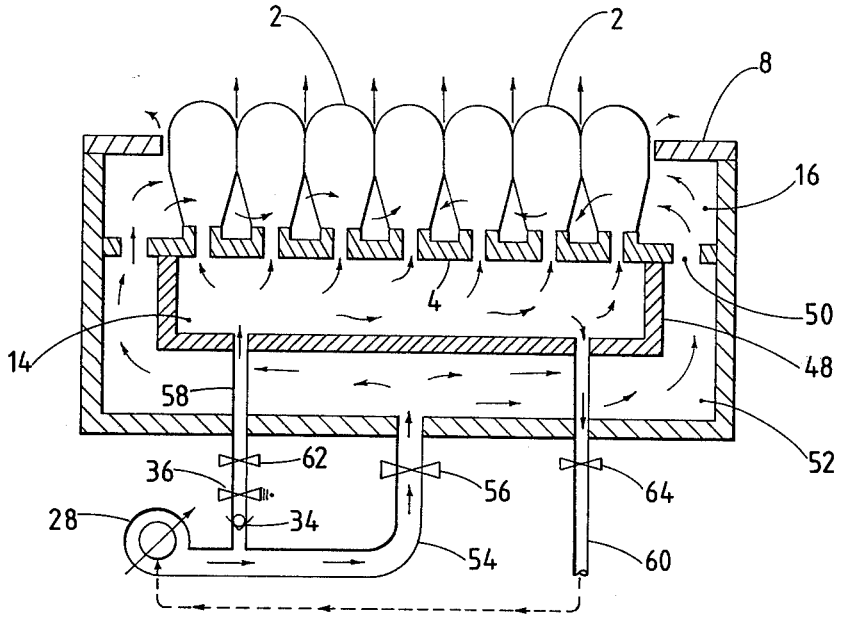
FIG. 21 illustrates a cross-section of a dual mode operation embodiment which is distinguished from that in FIG. 20 by the provision of peripheral orifices in the board to which the cells are attached, by which orifices fluid is conducted into the upper plenum. A discrete internal plenum is suspended from the cell board.

FIG. 21 illustrates a variation of the system shown in FIG. 20 and previously described. Many of the component parts are common and the principle of operation is the same. It is specifically addressed in order that a configuration illustrated later may be more easily understood. The arrangement illustrated in FIG. 21 is utilized in multi-module form to provide the articulated fluid support system shown in FIGS. 25 through 29.

The principal modification from FIG. 20 is that the internal plenum is formed by the lower surface of the cell board 4 and a suspended box-like structure 48. This latter 48 does not extend the full width or length of the cell board 4. That portion of the cell board which extends between the box-like structure 48 and the outer structure 6 is pierced at intervals by holes or slots 50. The space formed by the lower surface of the cell board 4 external to the box-like structure 48 and internal to the outer structure 6 will hereinafter be referred to as the lower external plenum 52. Pressurized fluid is introduced into this space 52 from the variable speed pump or blower 28 by means of a duct 54 provided with a variable orifice or valve 56. This pressurized fluid passes through the slots 50 in the cell board into the external plenum chamber 16. Provision is made for the supply of pressurized fluid to the internal plenum 14 by means of a duct 58 provided with a non-return valve 34 and variable relief valve 36. This duct 58 passes through the external structure 6 in a fluid-tight manner and continues through the lower external plenum 52 and penetrates the box structure 48 of the internal plenum. Fluid flow through this duct pressurizes the internal plenum 14 and inflates the cells 2. A return fluid flow path is provided from the internal plenum in a similar manner by the duct 60, which is routed to the intake of the pump or blower 28. Variable orifices or valves 62, 64 are provided in the ducts 58, 60 to provide means of controlling the pressure in the internal plenum of alternatively isolating or depressurizing this space.

Active Fluid Support Systems with Single Pressure Source

Figure 22:
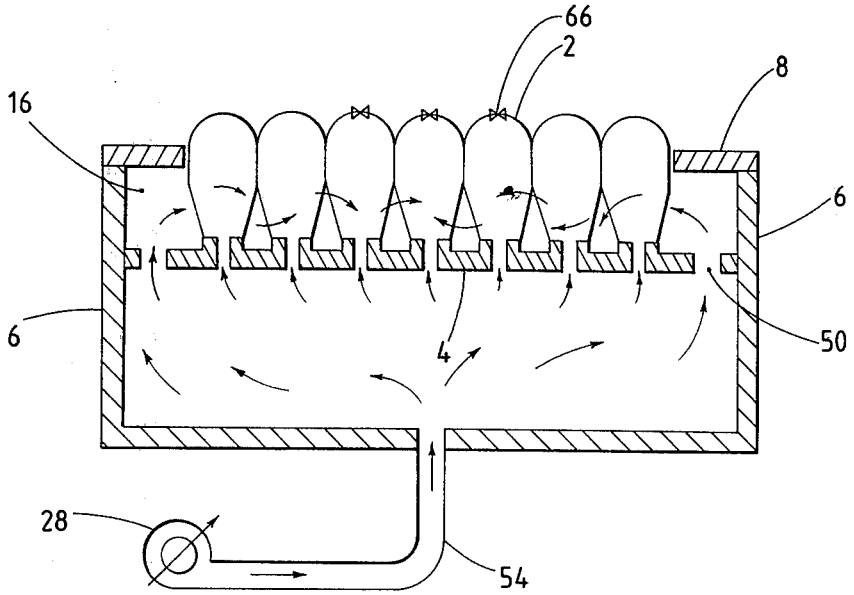
FIG. 22 is a cross-sectional view of an embodiment operating only in the active mode. A single pressure source is utilized to pressurize both the plenums above and below the cell board by means of peripheral orifices in the cell board. No discrete internal plenum is provided nor is there any provision for independent regulation of pressure on the upper and lower surfaces of the cell board, as this is now common space.

FIG. 22 illustrates a fluid support system having only one source of pressurized fluid supply. The arrangement has some components common to the arrangements previously described, but is distinguished by the deletion of those components associated with the provision of dual mode operation. Operation is possible only in the active mode. Pressurized fluid is supplied from a variable speed pump or blower 28 through a duct 54 which penetrates the outer structure 6. No discrete internal plenum and external plenum are provided for. Fluid entering the space below the cell board and bounded by the structure 6 will enter and inflate the cells, establishing the cell matrix, and simultaneously fluid will pass through the slots 50 in the cell board and pressurize the space previously referred to as the external plenum 16. Some portion of the flow will escape to ambient from the external plenum 16. No flow escapes from the internal cell fluid. Consequently, there will be a slight positive differential between the internal and external pressures of the cells, ensuring proper inflation and establishment of the cell matrix. If subsequently a body is placed upon the upper surface of the cell matrix, the load sensing and valving actions previously described will occur, leaving the body supported upon a cushion of fluid. It has been established that, in certain cases, the provision of an additional orifice 66 in the upper hemispherical portion of at least a few of the cells benefits the collapsing action of the cell matrix in the loaded area.

Figure 23:
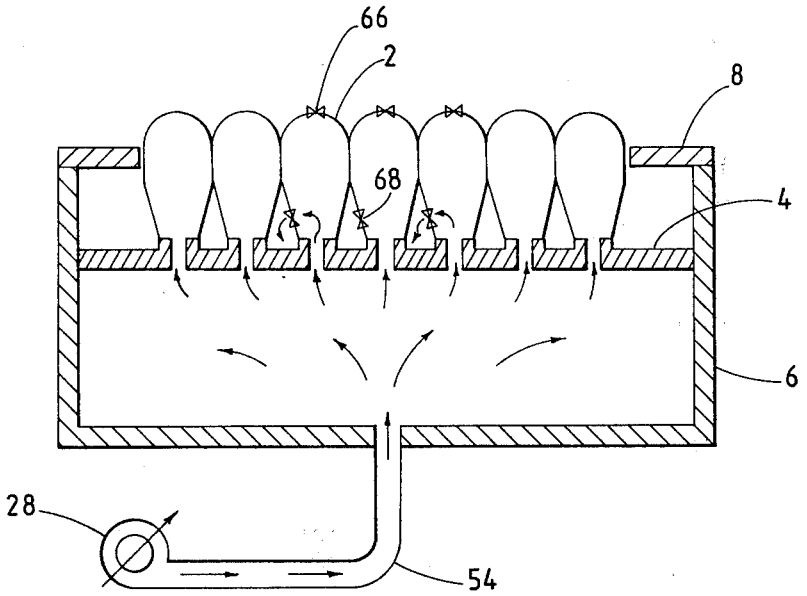
FIG. 23 is a cross-sectional view of an embodiment operating only in the active mode. A single pressurized supply is fed to the underside of the cell board from where it passes into the interior of the cells and from there by means of holes in the lower portion of the cells passes into and pressurizes the upper plenum.

FIG. 23 illustrates another configuration which operates only in the active mode. This is distinguished from the system illustrated in FIG. 22 only by the means of fluid supply to the exterior plenum 16. This supply is now taken from the interior of the cells by means of holes (68) in the lower portion of the cells below the line of mutual contact instead of the slots 50 shown in FIG. 22.

Curved Cell Board

Figure 24:
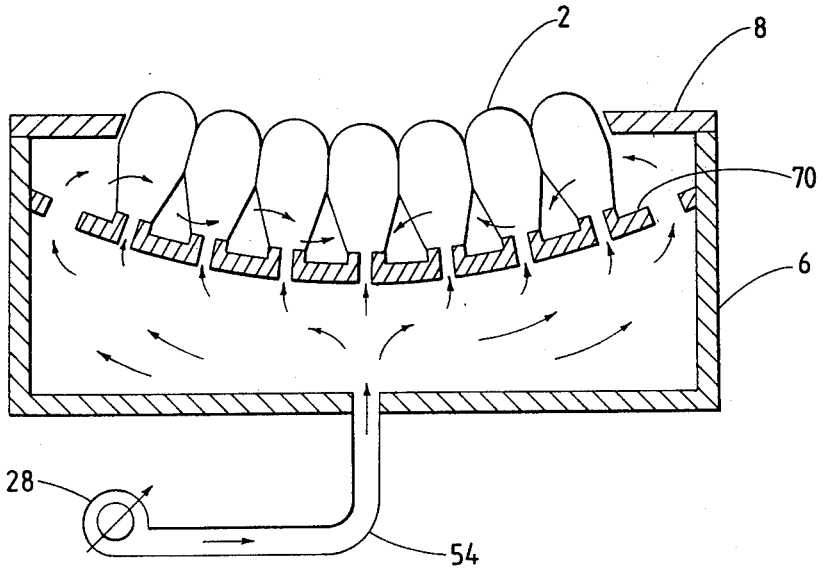
FIG. 24 illustrates a cross-section of an embodiment in which the board to which the cells are attached has a generally concave upper surface. The specific embodiment illustrated is that of FIG. 22, but the principle is generally applicable.
Figures 25, 26, 27, 28, 29:
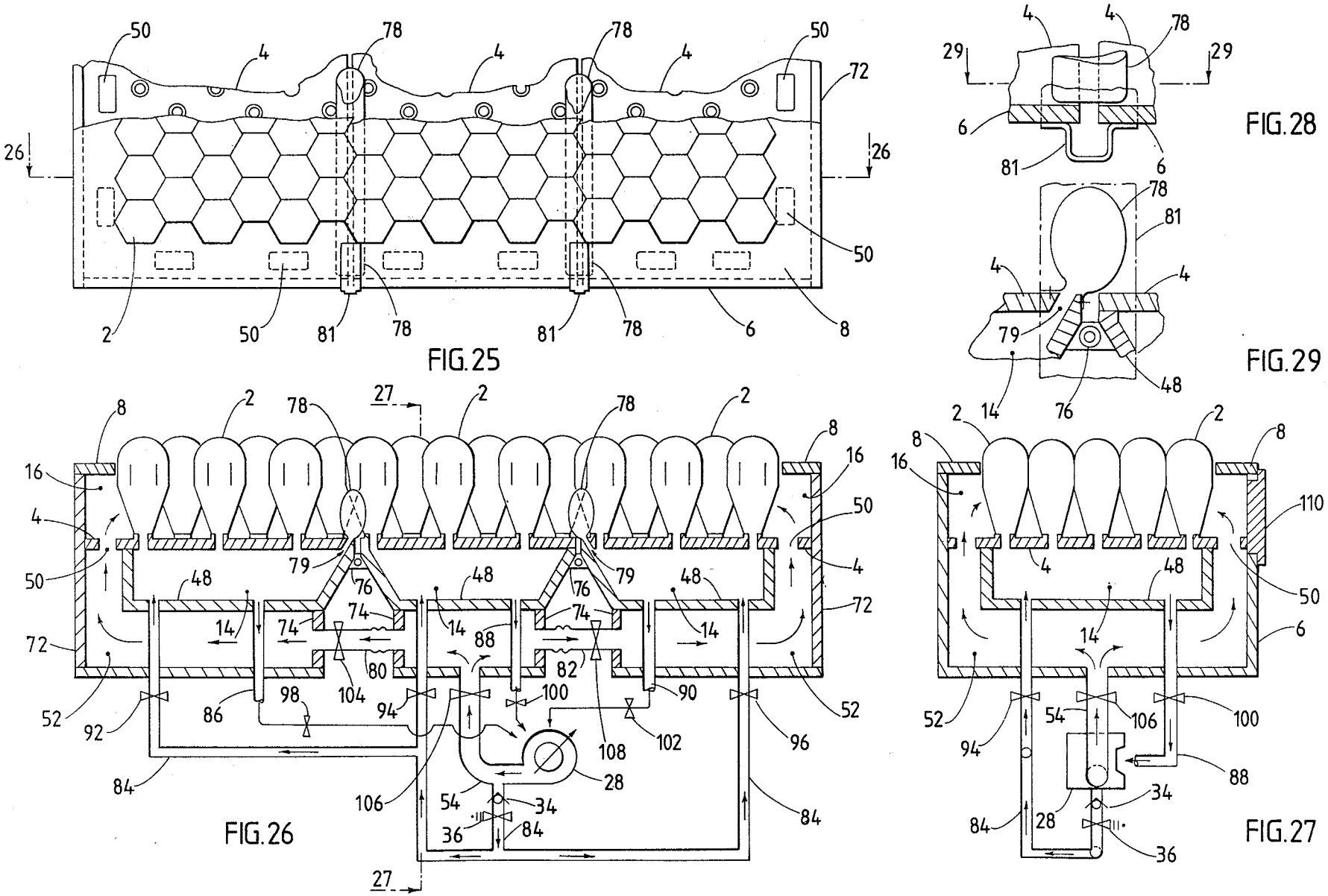
FIG. 25 is a partial plan view of an embodiment having three discrete cell matrices and means for provision of differential pressure within these matrices, together with articulated movement.
FIG. 26 is a longitudinal vertical cross-section of FIG. 25.
FIG. 27 is a transverse, vertical cross-section of FIG. 26.
FIG. 28 is a horizontal section in way of the articulation and compartmentalization points between the discrete matrices of FIGS. 25 and 26.
FIG. 29 is a vertical section corresponding to FIG. 28.

FIG. 24 illustrates a feature which is applicable to all the embodiments described. The cell board 70 may be configured to have a generally concave surface, thereby providing a centralizing and stabilizing force on any body being supported and restraining any tendency to roll out of the support system. In the larger full body support systems, the concavity will generally be undirectional but the smaller, partial systems may additionally utilize a cell board having an upper surface which forms at least part of a generally spherical surface.

Articulation, Compartmentation and Pressure Management System

The pressure required to support the individual components of a human body varies quite widely. Typically, the pressure required to support the buttocks and abdomen is approximately twice that required to support the legs or chest area. While it is practicable to support the whole of the body at the pressure necessary to support the densest portions, it is advantageous to compartmentalize the overall cell grouping or matrix into a number of discrete sections operating at different pressures related to the density of the portion of the body being supported. This will not only enable the lowest possible support pressures to be achieved, but will result in considerably less overall power requirements for the pump or blower units.

FIGS. 25 through 29 depict a configuration incorporating this feature of sections at differing pressures (hereinafter referred to as compartmentalization). The construction and operational principles of each section of the compartmentalized fluid support system is basically identical to that described by FIG. 21. However, the integration of the separate units requires some minor structural changes and the provision of an integrated fluid flow management system, together with a substructure such as a standard, articulated hospital bed. This latter is not illustrated but will provide the articulation by which the attitude of a user of the fluid support system may be varied. Three complete, discrete articulated sections are shown from left to right in FIG. 25, respectively—the foot section, mid-section and head section, by which terminology they will hereinafter be referred to. In order to accommodate the varying densities of a human body, the mid-section will be at the highest pressure with correspondingly lower pressures used in the head and foot sections. Separate variable speed blowers could be utilized for each section; however, this would be unduly cumbersome and expensive. Consequently, the arrangement shown incorporates a pressure management system utilizing a single pump or blower unit 28.

In each end section, the cell board 4 extends longitudinally beyond the cell grouping or matrix and is attached in a fluid-tight manner to transverse vertical end members 72. The cell boards also extend transversely beyond the cell matrices and are similarly attached to the outer structure 6. This outer structure 6 is flexibly bridged 81 at the points of articulation between the three sections in order that a fluid-tight seal is provided at the sides of the overall support system.

As described and illustrated in FIG. 21, a box-like structure 48 is attached to the lower surface of each section of the cell board, thereby forming internal plenums 14 for the foot, mid- and head sections. Lower external plenums 52 are also provided; in the case of the end sections by the transverse members 72, the lower surface of the box-like structure 48, the transverse members 74, the lower surface of the cell board extending beyond the structure 48, together with the outer structure 6. In the case of the central section, the lower external plenum is similarly formed by a combination of the lower surface of the cell board 4, the outer structure 6 and the two transverse members 74.

The portion of the cell board 4 extending beyond the structure 48 to the outer structure 6 and the end members 72 is pierced by a number of holes or slots 50 which allow pressurized fluid from the lower external plenum chambers 52 to flow into the external plenums 16 above the cell board. The abutting sections of the arrangement are suitably shaped to allow articulation. Hinges 76 are provided at these points.

Separation of the upper external plenum chambers into discrete sections is accomplished in the following manner.

At the transverse interfaces between the cell matrices of the head section and mid-section, the mid-section and foot section, hollow, inflatable, flexible transverse members 78 are placed. These extend across the full width of the upper plenum chamber 16. Each is generally circular or ogival in cross-section when inflated, depending upon the taper of the cells comprising the cell matrices. Each is configured such that, when inflated by fluid bled through an orifice 79 from its respective internal plenum chamber, it will extend to a height above the cell board 4 at least equal to the distance of the plane of contact of the inflated cell matrix above the cell board. Consequently, fluid entering the external plenum space 16 above the cell board, through the holes 50 provided from the lower external plenum spaces, will be contained within three discrete upper plenum spaces 16, these spaces being bounded by various combinations of the top of the cell board 4, the rigid structure above the cell board 72, 6, 8, the inflatable transverse members 78 and the seals horizontally provided by the inflated cell matrices when the internal plenum chambers 14 are pressurized. A variable speed pump or blower 28 supplies pressurized fluid through a duct 54 to the lower external plenum of the mid-section. The fluid flow then passes from the mid-section to the lower external plenums 52 of the foot and head sections by means of two ducts 80, 82. In all sections, the flow will then pass by means of the holes or slots 50 in the cell board 4 into the respective discrete external plenum chambers 16 above the cell board.

The ducts 80, 54, 82 are each provided with a variable orifice or valve. These are numbered 104, 106 and 108 for the foot, mid- and head sections, respectively. For any given flow from the pump or blower 28, the valve 106 may be adjusted to provide the desired degree of pressurization of the external plenum chamber 16 of the central section. As noted above, the pressure required in the central section is greater than that required or desired in the foot and head sections and valves 104, 108 are incorporated to provide the necessary pressure drop to accomplish this condition.

At a point close to the discharge of the pump or blower unit 28, a branch duct 84 is taken from the duct 54. This provides, by means of additional branching, a pressurized fluid supply to each of the discrete internal plenums 14. A return fluid flow path from each internal plenum is provided through three discrete ducts 86, 88, 90, each of which is separately routed back to the intake of the pump or blower 28. Variable orifices or valves 92, 94, 96 are provided in the supplies to the internal plenums of the foot, mid- and head sections, respectively. Similarly, the return flow paths are controlled by means of valves 98, 100, 102. As in FIG. 21, a non-return valve 34 and relief valve 36 are incorporated in the internal plenum fluid supply line 84. The variable orifices or valves in the fluid supply and return lines of the internal plenums allow the pressure within each internal plenum to be individually regulated to a level commensurate with the pressure required and desired in the respective external plenum in order that a body may be supported with the lowest possible levels of fluid pressure for the appropriate body section. (As noted above, the mid-section of a body is more dense than either the foot or head sections.) The fluid mechanisms by which the body is supported have been previously described. Operation of each section of this fluid support system is as described for and illustrated in FIG. 21. It may be operated in either the active mode or alternatively in the passive mode.

The active mode of operation is achieved by the management of the valves 104, 106, 108 to provide the desired pressure in each of the three external plenum chambers. Concurrently, the pressure within the respective internal plenum chamber and cells is similarly adjusted by use of the valves 92 and 98, 94 and 100, and 96 and 102. When it is desired to operate the support system in the passive mode, valve 106 is closed, thereby stopping flow to the external plenums. This reduction in the flow results in a higher delivery pressure from the pump or blower 28 and this, in turn, causes an increase in the internal inflation pressure of the cell matrices. Valves 98, 100, 102 in the return lines from the respective internal plenums are then also closed, resulting in a still higher internal inflation pressure in the cell matrices, as the pump or blower is now producing its maximum pressure under "no flow" conditions.

One particular advantage of this arrangement, which allows the support to be achieved by either active or passive modes is that, while the patient is normally supported in the optimum manner by means of the active system, the passive mode may be utilized to allow removal of a cell grouping or matrix section for cleaning purposes, leaving the patient supported upon the remaining sections operated on closed circuit only. This can typically be done as follows: If it is desired to remove the center section, which is the most likely to become soiled, the system is put into the passive mode as described above. Valve 94 is then closed in order to prevent flow to the center internal plenum. Valve 100 is then opened and the connection of the internal plenum by means of duct 88 to the suction or intake of the pump or blower 28 will deflate the center section of the cell matrices. The patient or body will then be supported on the two outer sections only.

Under these conditions, a section or door 110 in the side vertical member 6 of the upper external plenum (which is no longer pressurized) is removed, thereby allowing the cell board 4 of the center section (which is slotted into the remainder of the center internal plenum box) to be removed by withdrawing it, complete with the deflated cell grouping or matrix, through the space created in the side vertical member 6 by removal of the section or door. A cleaned or sterilized section may then be sutstituted and the support system returned to operation in the active mode.

The above arrangement, although specifically addressed to a support system having three discrete sections operating at different support pressures, can be utilized in configurations comprising any number of two or more sections.

Partial Body Support

Figure 30:
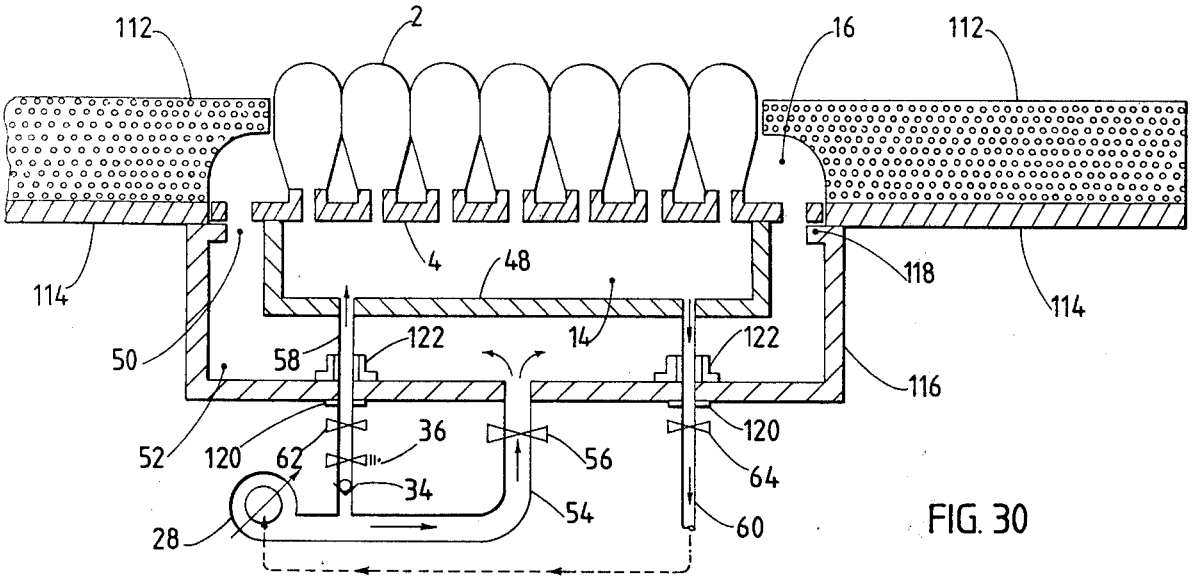
FIG. 30 illustrates an embodiment in which only a portion of the body is supported upon a fluid support system, the remainder being conventionally supported upon a mattress-like structure. The central portion of this longitudinal, vertical cross-section illustrates a fluid support system as shown in FIG. 21 and the surrounding portion is representative of a foam mattress. The upper portion of the fluid support system is removable.
Figure 31:
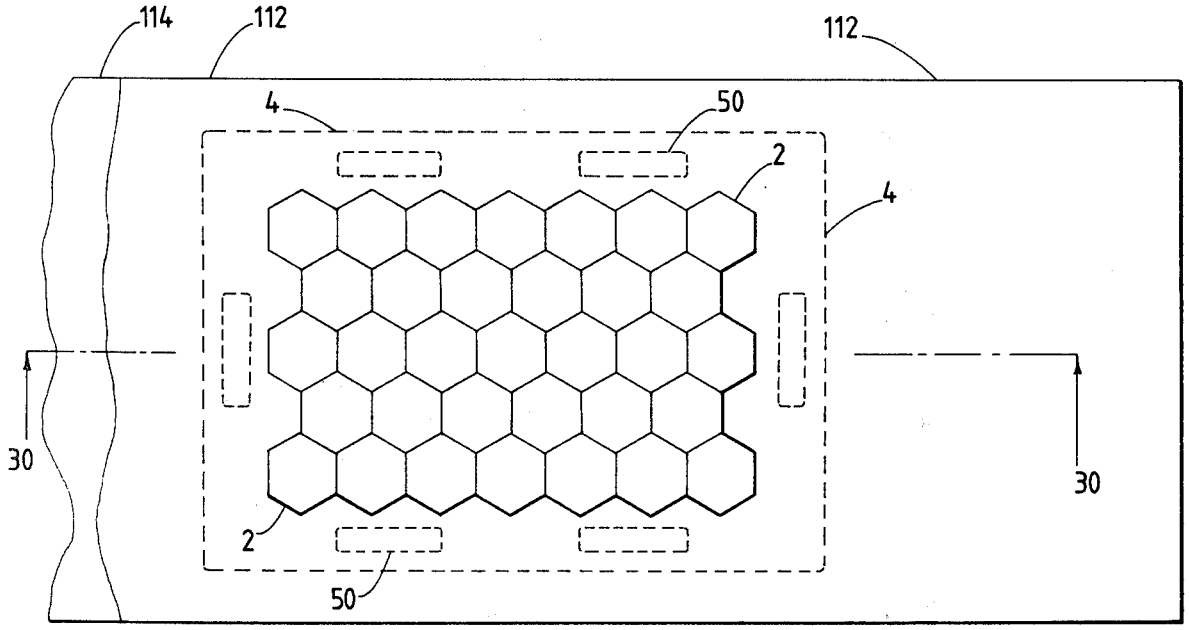
FIG. 31 is a partial plan view of FIG. 30 illustrating the cell matrix contained within a foam mattress.
Figure 32:
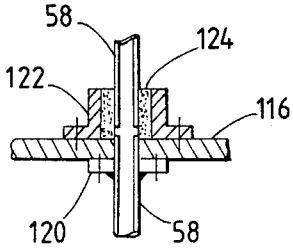
FIG. 32 is an enlarged vertical cross-section of the detachable fluid supply and return ducting to the internal plenum in way of the outer structure in FIG. 30.

This arrangement illustrated in FIGS. 30, 31 and 32 is configured such that the fluid support system comprises only some portion of the total area of the patient support. In this way, both the initial cost and the powering requirements may be minimized while, at the same time, low pressure fluid support may be applied to selected areas requiring the lowest possible support pressure without skin contact. The fluid support system portion of the overall arrangement may be incorporated in any of the configurations previously described. The arrangement illustrated utilizes the fluid support system described in FIG. 21.

The support system typically comprises a foam mattress 112 which surrounds a fluid support system composed of a cell matrix and ancillary equipment. The whole is supported upon a substructure of bed-like proportions. The configuration illustrated has no provision for articulation but this may be incorporated. A structure 114 supports the mattress 112. In any desired area, the structure 114 is provided with a recessed box-like substructure 116 which incorporates a shelf or sill 118 near its upper, open end, upon which the cell board 4 rests. From the lower surface of the cell board 4, a fluid-tight box-like structure 48 is suspended, the edges of the cell board 4 extending beyond this box structure. The sides of the recessed substructure 116 form, in combination with the lower surface of the cell board, a lower external plenum 52 from which fluid may pass through orifices 50 in the cell board to an upper external plenum 16, formed by the plane of contact of the cell matrix, the upper surface of the cell board 4 and a boundary or matrix retaining, non-porous foam mattress 112, the mattress having been suitably shaped to accommodate the matrix tessalation.

An internal plenum chamber 14 is formed by the lower surface of the cell board 4, and the inner surface of the box-like structure 48. The supply and control of the pressurized fluid is as described for and illustrated by FIG. 21. However, provision is made at the points at which the ducts 58, 60 penetrate the lower horizontal member of the structure 116 for fluid-tight but easily disconnected joints in the said ducts. The arrangement of this is illustrated in FIG. 32. Each of the ducts 58, 60 is provided with a flange 120 which attaches rigidly to the lower surface of the structure 116. On the upper surface of this structure 116 is attached a flanged collar 122 lined with a deformable sleeve 124 of suitable diameter to accommodate the upper portion of the duct which is attached to the inner plenum structure 48.

When required, i.e., for cleaning, the whole center portion of the apparatus (comprising of the cells 2, cell board 4 and internal plenum box 48), together with the attached portion of ducts 58, 60 may be pulled upward through the foam mattress and later restored by reversing the process.

in the manner previously described for FIG. 21, the central fluid support system may be made to operate in either the active or passive modes.

When a patient is laid upon the mattress/fluid support system combination, selected areas of the body (determined by the position in which the cell grouping or matrix has been placed) will be supported by fluid (generally air) in the manner previously described, whereby the internal and external cell pressures are relatively adjusted and subsequent sealing and valving actions of the cell result in the formation of a pressurized fluid cushion. Sealing in those areas where the cell grouping or matrix interfaces with the surrounding mattress and the body simultaneously will be achieved by compression and deformation of that mattress.

Boundary Members or Restraints

In order to contain both the cell grouping or matrix itself and, more importantly, the fluid within the upper external plenum which surrounds the lower outside of the cells above the cell board and below the seal formed by the mutual cell contact, it is necessary to provide a fluid-tight member surrounding and containing the cell grouping or matrix. This is hereinafter referred to as the boundary member.

In the majority of configurations illustrated, this is constructed of inflexible material such as metal, with a foam pad provided for the patient's comfort. However, it can alternatively be beneficially constructed from flexible or resilient materials as described below.

Figure 33:
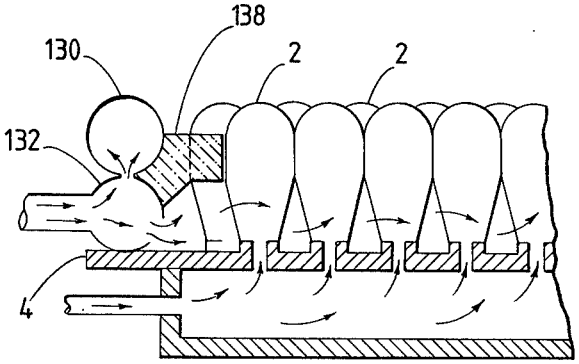
FIG. 33 is a partial cross-sectional view of a fluid support system in which the peripheral restraint of the cell matrix and containment and supply of the upper plenum fluid is by means of two inflatable peripheral tubes with a formed foam attachment.
Figure 34:
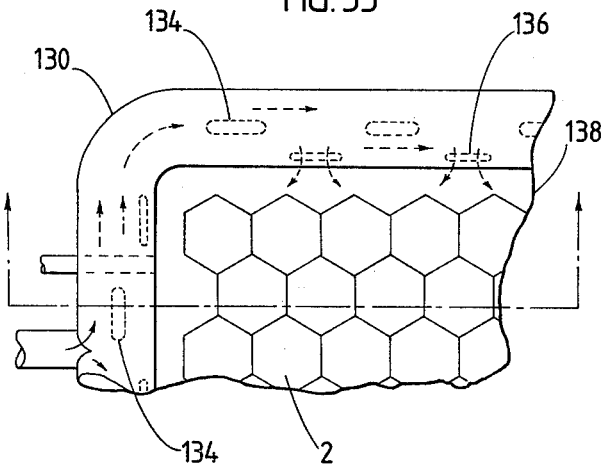
FIG. 34 is a partial plan view of FIG. 33 illustrating radiused corners.
Figure 35:
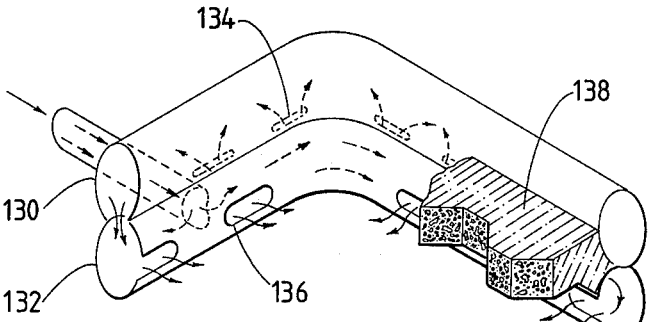
FIG. 35 is a partial perspective view of the peripheral tubing and foam attachment of FIG. 33.

FIG. 33 illustrates a boundary member comprised of inflatable structure. Two or more internally pressurized tubes are utilized 130, 132. The necessary rigidity is gained by inflating the structural tubes with pressurized fluid enroute to the external plenum of the matrix. (FIGS. 34 and 35 provide a plan view and oblique views of the arrangement.) This is accomplished by feeding the fluid supply into the lower of the two peripheral tubes 132. A number of slots 134 are cut in the abutting material of the two peripheral tubes. This allows the fluid to enter and pressurize the upper tube. Other slots 136 are cut in the lower tube on the face adjoining the plenum surrounding the cell lower extremities, thereby allowing the pressurization of this plenum.

The interface of the boundary member with the cell matrix is accomplished by means of a shaped or molded non-porous foam block 138 which is attached to the peripheral tubes 130, 132. The required corners may be fabricated as shown in the plan view of FIG. 34, with radiused fabric joints or, alternatively as shown in FIG. 38, with mitered fabric joints.

Figure 36:
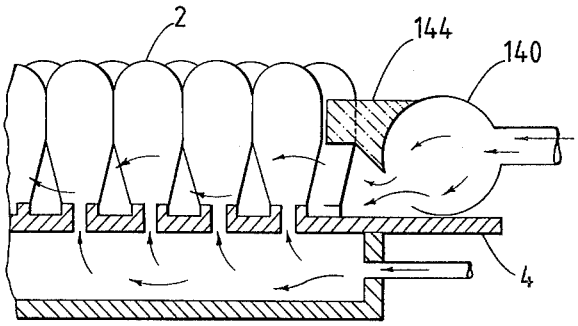
FIG. 36 is a partial cross-sectional view of a fluid support system in which the peripheral restraint of the cell matrix and the supply to and containment of the upper plenum fluid is by means of a single, peripheral tube with a formed foam attachment.
Figure 37:
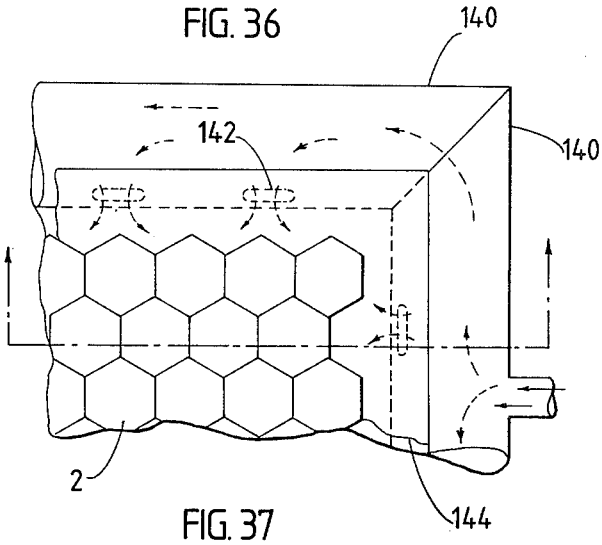
FIG. 37 is a partial plan view of FIG. 36 illustrating mitered corners.
Figure 38:
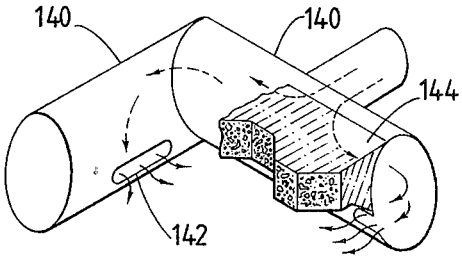
FIG. 38 is a partial perspective view of the peripheral tube and foam attachment of FIG. 36.

FIGS. 36, 37 and 38 illustrate a similar arrangement comprised of a single peripheral tube. This again utilizes the fluid supply enroute to the upper plenum chamber to provide the necessary pressure to provide stiffness. Fluid entering the tube 140 from the pressurized supply is distributed around the periphery of the apparatus and, from there, passes through a number of slots 142 into the upper plenum. The interface sealing with the cell matrix is again accomplished by the use of a suitably shaped non-porous foam block 144, attached to the peripheral tube 140. Corners may be either radiused or mitered.

Figure 39:
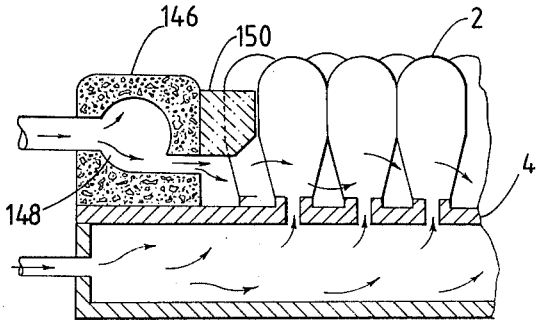
FIG. 39 is a partial cross-section of a fluid support system in which the boundary or peripheral restraints and fluid supply to the upper plenum are achieved by the use of a resilient block containing a fluid duct.

FIG. 39 illustrates a boundary member 146 fabricated from resilient non-porous foam material. The boundary member is of sufficient cross-section to accommodate an internal duct by means of which fluid is supplied to the upper external plenum. The interface with the cell matrix is again accomplished by means of a suitable foam block 150.

Figure 40:
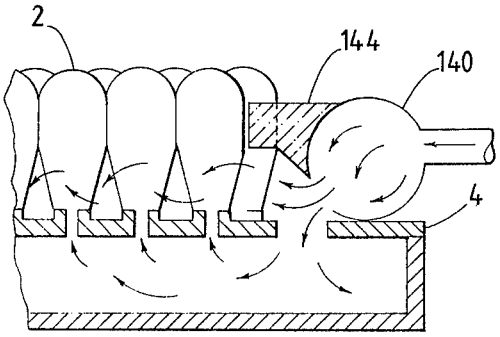
FIG. 40 is a partial cross-section of a fluid support system utilizing a single pressure source and common source plenums in which the supply to the plenums is by means of a single peripheral flexible duct which also restrains the cell matrix and contains the fluid in the upper portion of the support system.

FIG. 40 illustrates a variation of the system shown in FIGS. 36, 37 and 38. This applies where it is desired to operate the fluid support system from a single supply of fluid. In this configuration, additional porting for fluid to enter and pressurize the lower plenum and from there, fill and pressurize the cell matrix is provided.

Overall Considerations

Figure 41:
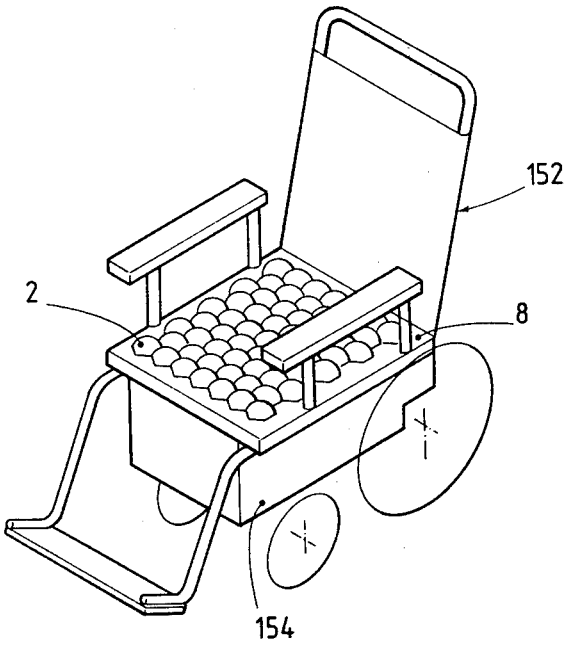
FIG. 41 is a perspective view of a wheelchair embodying a fluid support system which is self-contained.

FIG. 41 depicts a wheelchair 152, the seat of which is a fluid support system as previously described. The necessary plenums, fans and valves are contained within the box 154.

Figure 42:
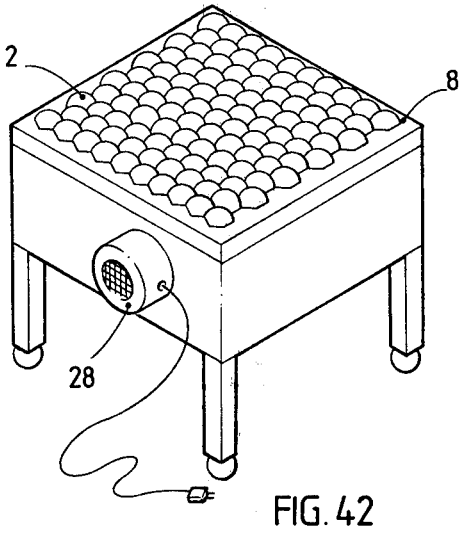
FIG. 42 is a perspective view of a mobile, self-contained fluid support system, generally for partial body support.

FIG. 42 depicts a self-contained, mobile fluid support system which may be placed alongside a conventional hospital bed. It would be approximately 30 inches wide and 4 feet long. The patient's legs would be placed upon the mobile fluid support system and be supported in the active manner previously described. Under these conditions, the legs would be totally supported and buoyant. Consequently, beneficial exercise may be taken without recourse to moving the patient to a swimming pool or bath. This is particularly beneficial to paralyzed or partially paralyzed patients, where the fluid support allows movement of the legs or other portions of the body with low effort, as only inertia forces are required to be overcome, due to the balance of gravitational effects achieved.

Figure 43:
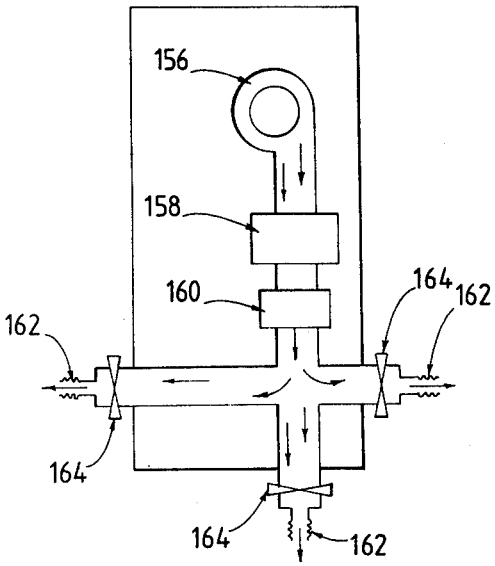
FIG. 43 diagrammatically illustrates a central supply for conditioned fluids to be supplied to a number of remote fluid support systems.

FIG. 43 depicts a central fluid supply station located in the proximity of a number of fluid support systems. A pump or blower 156 provides pressurized fluid which is then filtered 158 and heated 160 before being distributed in a number of ducts 162 which are provided with valves 164 and led through flexible ducting to a respective fluid support system.

Figure 44:
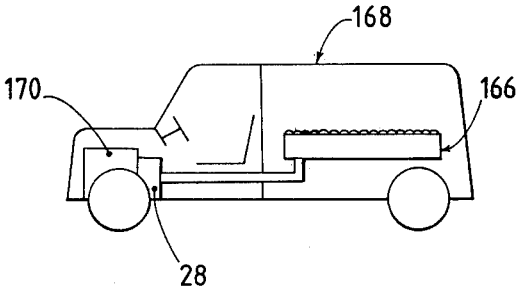
FIG. 44 diagrammatically illustrates a fluid support system contained within a motor ambulance.

FIG. 44 depicts a fluid support system 166 fitted within a motor ambulance 168, power to drive the pump or blower 28 being supplied by the prime mover 170 of the vehicle. Similar considerations also apply to helicopters, boats and other means of transport.

I claim:

1. A fluid support system comprising a plurality of flexible inflatable cells, the cells arranged in at least one group, each cell having a top portion, a central portion and a lower portion, the top portion being substantially hemispherical in vertical cross-section, the central portion being generally cylindrical and the lower portion tapering downward and inward; a board positioned beneath the cells, each cell connected at its bottom end to the board; a plurality of apertures in the board, an aperture aligned with each cell; means for supplying pressurized fluid to said apertures for inflation of said cells; the cells positioned relative to each other whereby upon inflation, the cells abut at their central portions and deform to a polygonal cross-section when viewed from the top; means for feeding pressurized fluid into spaces between said lower portions of said cells; and a boundary means surrounding a number of cells to define a group, the boundary means forming a lateral seal around the group, whereby the pressure in the sealed spaces between the lower portions of the cells can be made equal to or greater than the pressure on the interior of the cells, causing the cells below a patient resting on the support system to be deflated and to collapse to a level near the board.

2. A support system as claimed in claim 1, including separate means for feeding pressurized fluid to said apertures in said board and to said spaces between said cells.

3. A support system as claimed in claim 1, including apertures in at least some of the lower portions of said cells, for feeding pressurized fluid to said spaces.

4. A support system as claimed in claim 1, including two sets of apertures in said board, a first set of apertures forming said apertures aligned with the lower portions of said cells, and a second set of apertures communicating with said spaces.

5. A support system as claimed in claim 1, said pressurized fluid supply for said cells and said pressurized fluid supply for said spaces connected to a common pressurized fluid source.

6. A support system as claimed in claim 1, said pressurized fluid supply for said cells and said pressurized fluid supply for said spaces connected to separate pressurized fluid sources.

7. A support system as claimed in claim 1, said cells arranged in a plurality of groups, each group defined by a peripheral boundary.

8. A support system as claimed in claim 7, including a common fluid pressure supply to said groups.

9. A support system as claimed in claim 7, said peripheral boundary being common to adjacent groups.

10. A support system as claimed in claim 7, including separate pressurized fluid supply sources for each group.

11. A support system as claimed in claims 8 or 10, including an independent means for supplying pressurized fluid to said cells and to said spaces in each group.

12. A support system as claimed in claim 1, including a fluid supply duct extending for at least part of the periphery of a group and forming at least part of said boundary means, and apertures for supplying pressurized fluid from said duct to said spaces.

13. A support system as claimed in claim 1, said board concave in side view, said cell tops in a group having a generally concave configuration.

14. A support system as claimed in claim 1, said board flat in side view.

15. A support system as claimed in claim 1, said top portion connected to said lower portion, said center portion formed by the congruence of the top and lower portions.

16. A support system as claimed in claim 1, said center portion extending between said top portion and said lower portion and having a constant cross-section.

17. A support system as claimed in claim 16, said center portion having a polygonal cross-section.

18. A support system as claimed in claim 16, said center portion having a circular cross-section.

* * * * *